US005781965A

United States Patent [19]

Lu

[11] Patent Number: 5,781,965

[45] Date of Patent: Jul. 21, 1998

[54] EXTENSIBLE HANDLE DEVICE

[75] Inventor: Lien-Ching Lu, Miao Li Hsien, Taiwan

[73] Assignee: Ting Cheng Co., Ltd., Miao Li Hsien, Taiwan

[21] Appl. No.: 864,688

[22] Filed: May 29, 1997

[51] Int. Cl.[6] ..... B25G 1/04

[52] U.S. Cl. ..... 16/115; 190/39; 190/115

[58] Field of Search ..... 16/115; 190/115, 190/39

[56] References Cited

U.S. PATENT DOCUMENTS

| | | | |
|---|---|---|---|
| 5,499,702 | 3/1996 | Wang | 190/115 |
| 5,502,876 | 4/1996 | Wang | 16/115 |
| 5,620,070 | 4/1997 | Wang | 190/39 X |
| 5,630,250 | 5/1997 | Chou | 190/115 X |

*Primary Examiner*—Allan N. Shoap
*Assistant Examiner*—Tri M. Mai
*Attorney, Agent, or Firm*—Peterson, Wicks, Nemer & Kamrath, P.A.

[57] ABSTRACT

An extensible handle device has a pair of outer pipes, a pair of inner pipes disposed in the corresponding outer pipes respectively, a pair of cylinder blocks disposed in the corresponding inner pipes respectively, and a pair of push blocks disposed in the corresponding cylinder blocks respectively. A handle bar has a crossbar and a press bar inserted in the crossbar. The crossbar has two through holes to receive two inner pipes and at least two hollow posts disposed in the crossbar. Each of the push blocks has a slide groove to receive a slide block and a helical spring. Two cushions are inserted in two upper ends of the inner pipes. Each cushion receives a compression spring and a connecting rod. Each post receives a coiled spring and a respective protruded rod. Each outer pipe has a plurality of oblong holes.

2 Claims, 7 Drawing Sheets

EXTENSIBLE HANDLE DEVICE

BACKGROUND OF THE INVENTION

The invention relates to a handle device for a suitcase. More particularly, the invention relates to an extensible handle device for a suitcase.

Referring to FIG. 1, a conventional handle bar 11 has two grips 12 disposed in a suitcase 1. However, the conventional handle is not convenient to operate.

SUMMARY OF THE INVENTION

An object of the invention is to provide an extensible handle device which is easily operated.

Another object of the invention is to provide an extensible handle device which is easily assembled.

Accordingly, an extensible handle device comprises a pair of longitudinal outer pipes, a pair of inner pipes disposed in the corresponding outer pipes respectively, a pair of cylinder blocks disposed in the corresponding inner pipes respectively, and a pair of push blocks disposed in the corresponding cylinder blocks respectively. A handle bar has a hollow crossbar and a press bar inserted in the hollow crossbar. The hollow crossbar has two through holes formed in the hollow crossbar to receive two upper ends of the two inner pipes, at least two hollow plates disposed in the hollow crossbar, at least two hollow posts disposed in the hollow crossbar, and at least two round holes formed on the hollow crossbar. The press bar has two recess holes, two pairs of slots and at least two cage posts. Each of the cage posts has a protruded rod. Each of the slots has a slide hole formed in each of the slots. Each of the cylinder blocks has a rectangular hole. Each of the push blocks has a slide groove to receive a slide block and a helical spring abutting the slide block. Each of the push blocks is covered by a seal plate on the respective cylinder block. Two hollow cushions are inserted in the two upper ends of the inner pipes. Each of the hollow cushions receives a compression spring and a connecting rod having a lower end inserted in the respective cylinder block and an upper end disposed outside of the respective hollow cushion. Each of the hollow posts receives a coiled spring and a respective protruded rod. Each of the longitudinal outer pipes has a plurality of oblong holes. Each of the hollow plates are inserted in each of the respective slots. A pin passes through the respective round hole and the respective slide hole.

BRIEF DESCRIPTION OF THE DRAWINGS

FIG. 3A is a sectional view illustrating a cage post inserted in a holloe post;

DETAILED DESCRIPTION OF THE INVENTION

Figure 1:
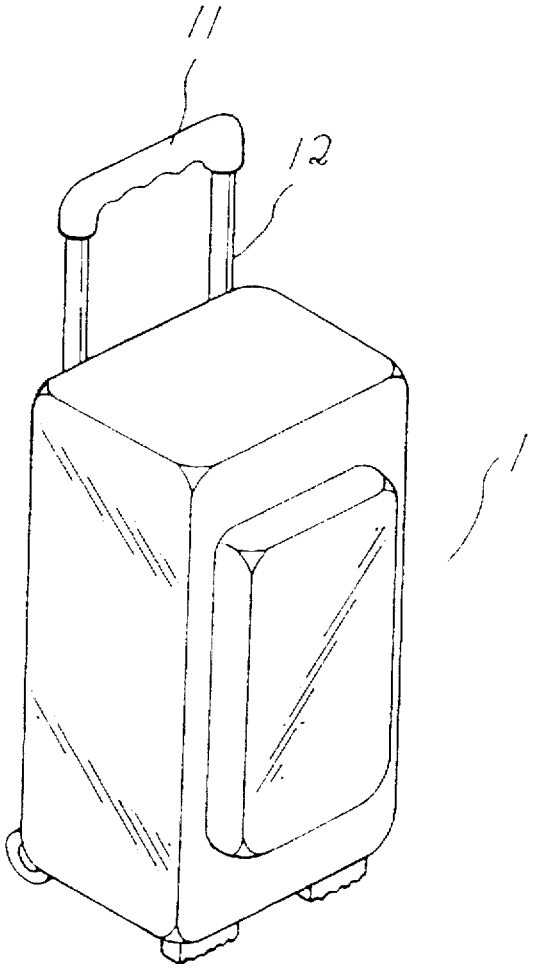
F I G. 1 PRIOR ART
FIG. 1 is a perspective view of a suitcase and a handle bar of the prior art.
Figure 2:
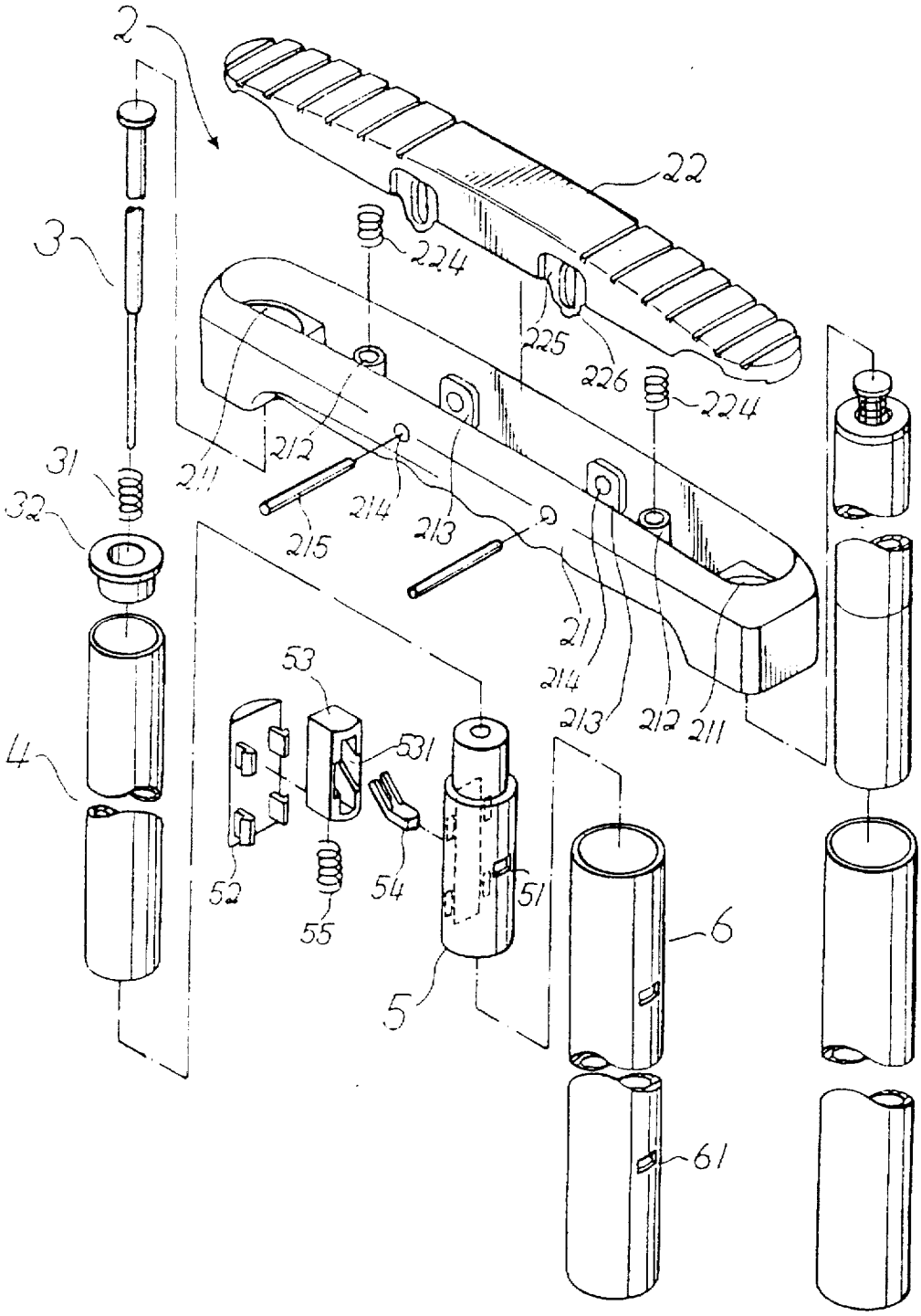
FIG. 2 is a perspective exploded view of an extensible handle device of a preferred embodiment in accordance with the invention.
Figure 2A:
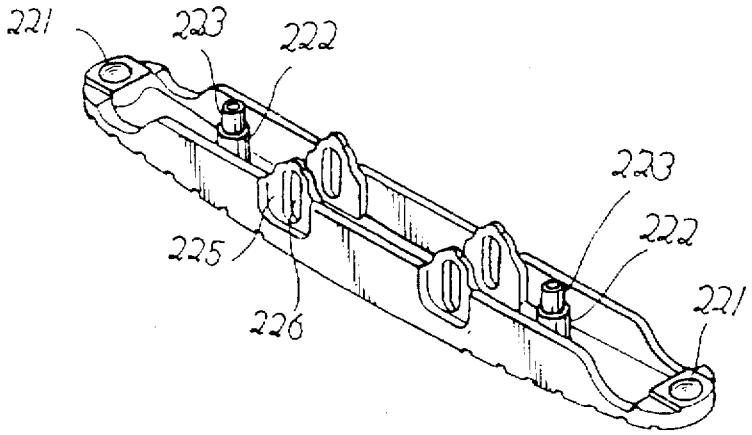
FIG. 2A is a perspective view of a press bar.
Figure 5A:
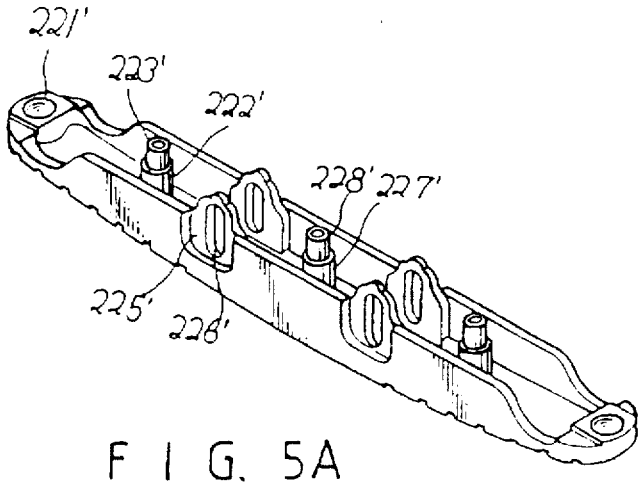
FIG. 5 is a perspective exploded view of an extensible handle device of another preferred embodiment in accordance with the invention.
Figure 3:
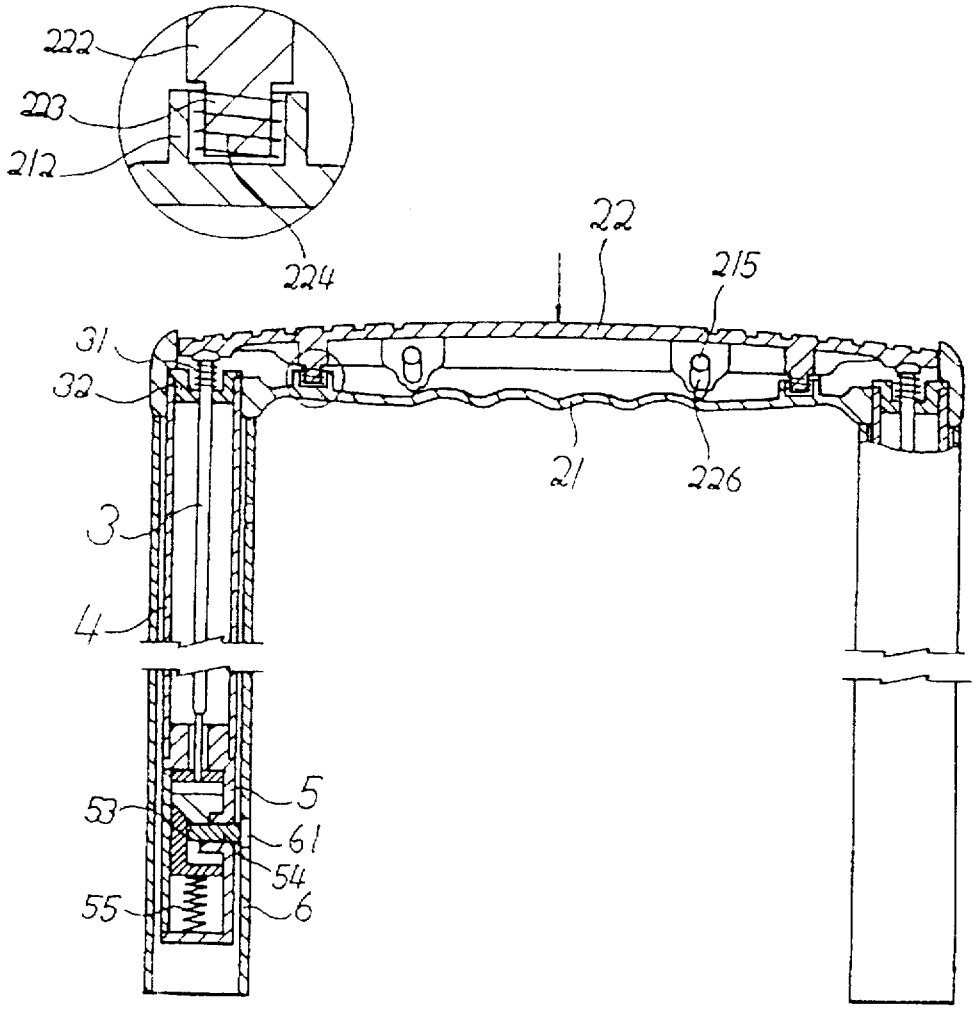
FIG. 3 is a sectional view of an extensible handle device of a preferred embodiment in accordance with the invention.
Figure 4:
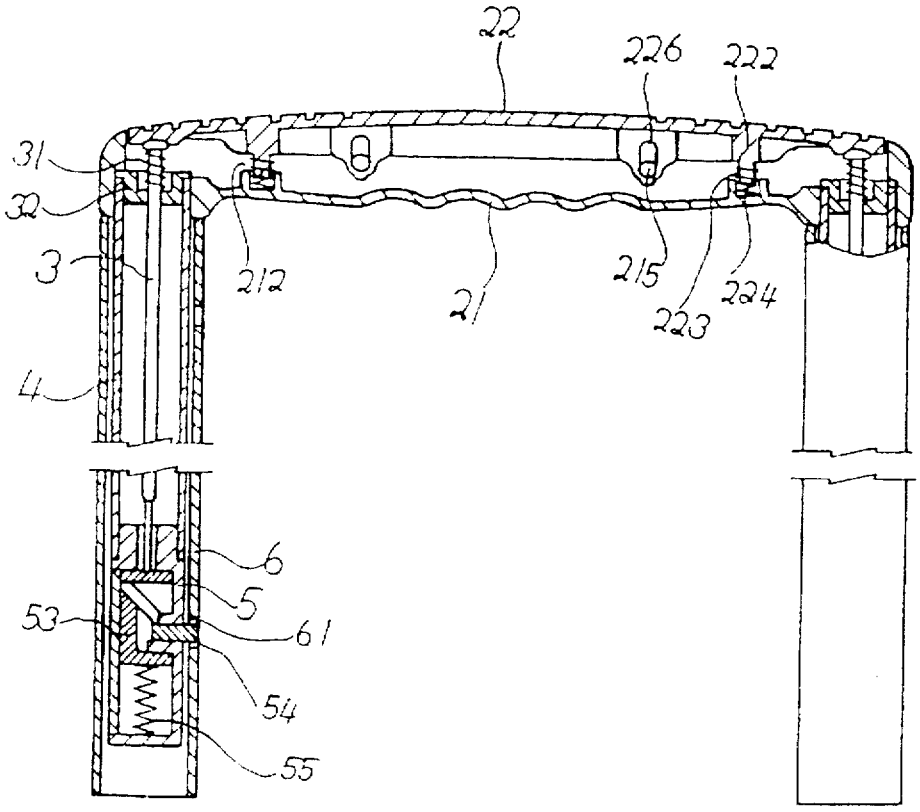
FIG. 4 is another sectional view of an extensible handle device of a preferred embodiment in accordance with the invention.

Referring to FIGS. 2 to 4, an extensible handle device comprises a pair of longitudinal outer pipes 6, a pair of inner pipes 4 disposed in the corresponding outer pipes 6 respectively, a pair of cylinder blocks 5 disposed in the corresponding inner pipes 4 respectively, and a pair of push blocks 53 disposed in the corresponding cylinder blocks 5 respectively. A handle bar 2 has a hollow crossbar 21 and a press bar 22 inserted in the hollow crossbar 21. The hollow crossbar 21 has two through holes 211 formed in the hollow crossbar 21 to receive two upper ends of the two inner pipes 4, at least two hollow plates 213 disposed in the hollow crossbar 21, at least two hollow posts 212 disposed in the hollow crossbar 21, and at least two round holes 214 formed on the hollow crossbar 21. The press bar 22 has two recess holes 221, two pairs of slots 225 and at least two cage posts 222. Each of the cage posts 222 has a protruded rod 223. Each of the slots 225 has a slide hole 226 formed in each of the slots 225.

Each of the cylinder blocks 5 has a rectangular hole 51. Each of the push blocks 53 has a slide groove 531 to receive a slide block 54 and a helical spring 55 abutting the slide block 54. Each of the push blocks 53 is covered by a seal plate 52 on the respective cylinder block 5. Two hollow cushions 32 are inserted in the two upper ends of the inner pipes 4. Each of the hollow cushions 32 receives a compression spring 31 and a connecting rod 3 having a lower end inserted in the respective cylinder block 5 and an upper end disposed outside of the respective hollow cushion 32. Each of the hollow posts 212 receives a coiled spring 224 and a respective protruded rod 223. Each of the longitudinal outer pipes 6 has a plurality of oblong holes 61. Each of the hollow plates 213 are inserted in each of the respective slots 225. A pin 215 passes through the respective round hole 214 and the respective slide hole 226.

Referring to FIG. 3, the press bar 22 is pressed downward. The connecting rods 3 move downward so that the push blocks 53 move downward also and the slide blocks 54 enters the push blocks 53 completely.

Referring to FIG. 4, the press bar 22 is released. The connecting rods 3 move upward so that each of the push blocks 53 move upward also and each of the slide blocks 54 is inserted in the respective rectangular hole 51 and one of the oblong holes 61.

Figure 5:
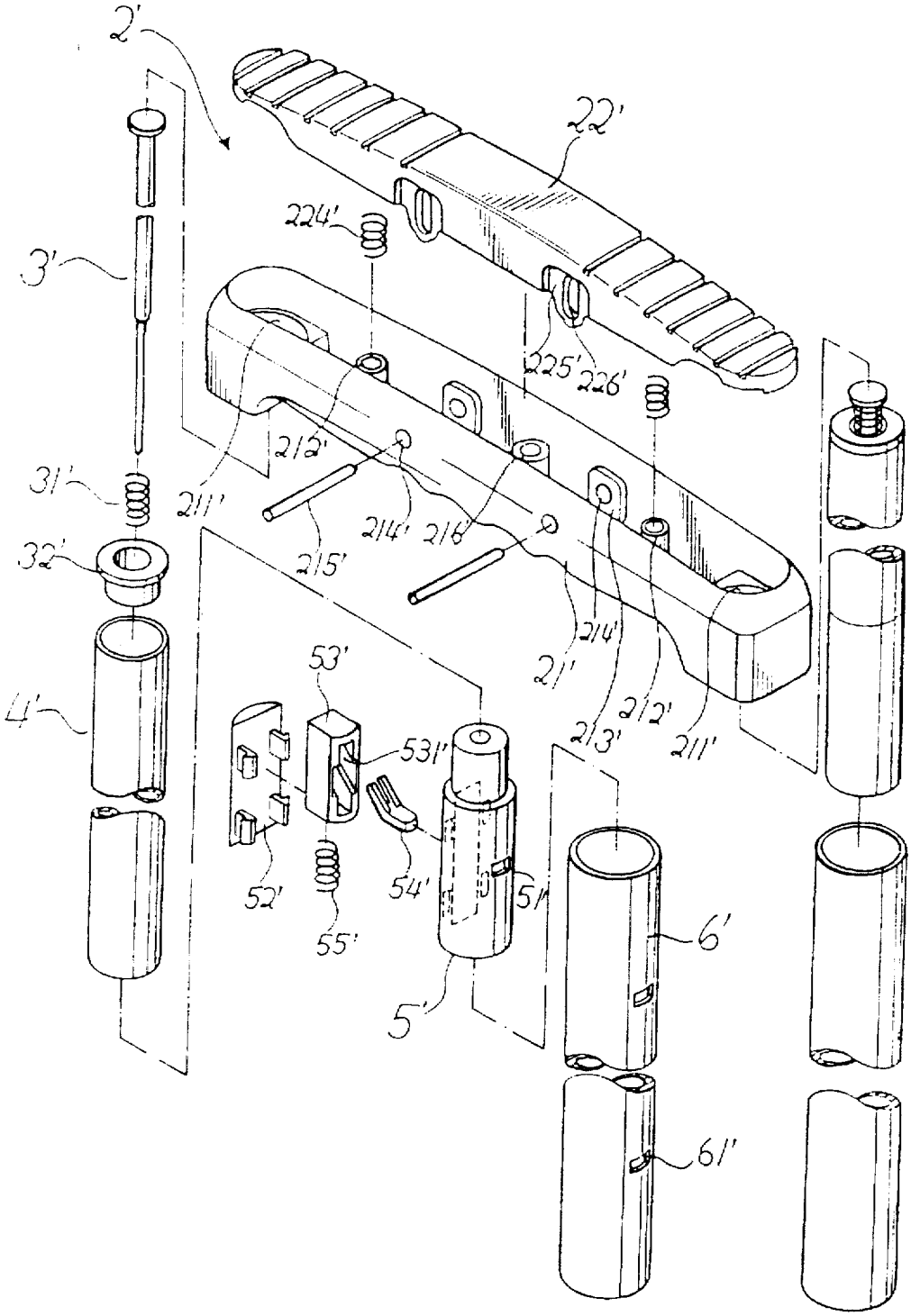
Figure 6:
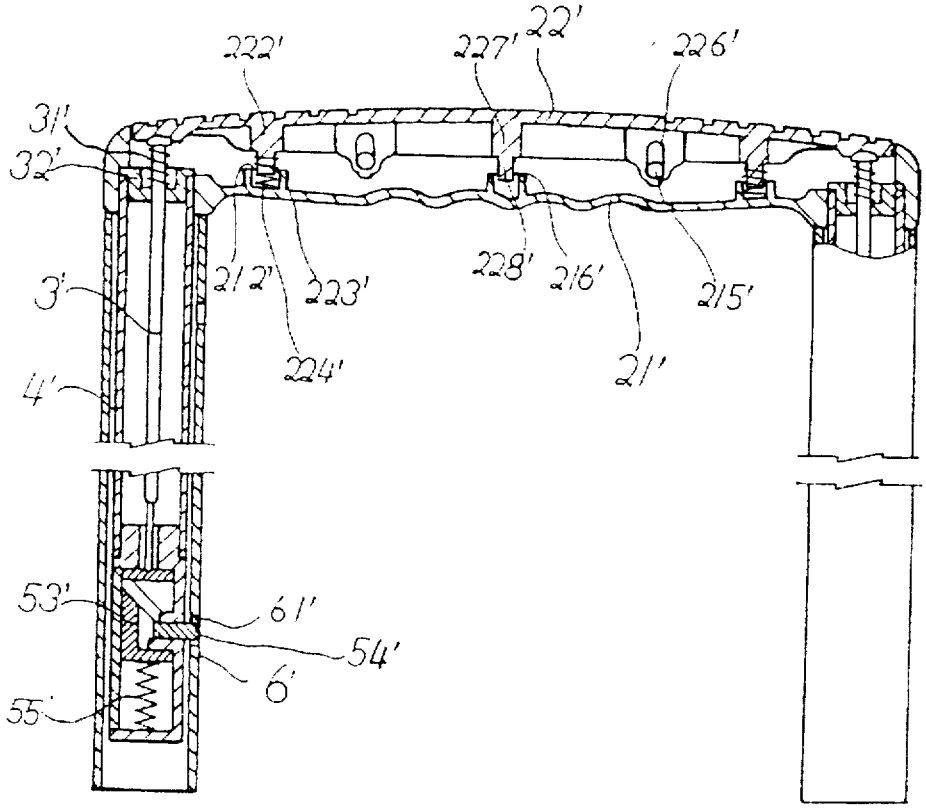
FIG. 6 is a sectional view of an extensible handle device of another preferred embodiment in accordance with the invention.

Referring to FIGS. 5 and 6, another extensible handle device comprises a pair of longitudinal outer pipes 6', a pair of inner pipes 4' disposed in the corresponding outer pipes 6' respectively, a pair of cylinder blocks 5' disposed in the corresponding inner pipes 4' respectively, and a pair of push blocks 53' disposed in the corresponding cylinder blocks 5' respectively. A handle bar 2' has a hollow crossbar 21' and a press bar 22' inserted in the hollow crossbar 21'. The hollow crossbar 21' has two through holes 211' formed in the hollow crossbar 21' to receive two upper ends of the two inner pipes 4', at least two hollow plates 213' disposed in the hollow crossbar 21', at least two hollow posts 212' disposed in the hollow crossbar 21', and at least two round holes 214' formed on the hollow crossbar 21'. The press bar 22' has two recess holes 221', two pairs of slots 225' and at least two cage posts 222'. Each of the cage posts 222' has a protruded rod 223'. Each of the slots 225' has a slide hole 226' formed in each of the slots 225'. Each of the cylinder blocks 5' has a rectangular hole 51'. Each of the push blocks 53' has a slide groove 531' to receive a slide block 54' and a helical spring 55' abutting the slide block 54'. Each of the push blocks 53' is covered by a seal plate 52' on the respective cylinder block 5'. Two hollow cushions 32' are inserted in the two upper ends of the inner pipes 4'. Each of the hollow cushions 32' receives a compression spring 31' and a connecting rod 3' having a lower end inserted in the respective cylinder block 5' and an upper end disposed outside of the respective hollow cushion 32'. Each of the hollow posts 212' receives a coiled spring 224' and a respective protruded rod 223'. Each of the longitudinal outer pipes 6' has a plurality of oblong holes 61'. Each of the hollow plates 213' are inserted in each of the respective slots 225'. A pin 215' passes through the respective round hole 214' and the respective slide hole 226'. An additional hollow post 216' is disposed in a center of the hollow crossbar 21'. An additional cage post 227' having a protruded rod 228' is disposed in a center of the press bar 22'.

The invention is not limited to the above embodiment but various modification thereof may be made. It will be understood by those skilled in the art that various changes in form and detail may be made without departing from the scope of the invention.

I claim:

1. An extensible handle device comprises:

a pair of longitudinal outer pipes, a pair of inner pipes disposed in the corresponding outer pipes respectively, a pair of cylinder blocks disposed in the corresponding inner pipes respectively, a pair of push blocks disposed in the corresponding cylinder blocks respectively, a handle bar having a hollow crossbar and a press bar inserted in the hollow crossbar, the hollow crossbar having two through holes formed in the hollow crossbar to receive two upper ends of the two inner pipes, at least two hollow plates disposed in the hollow crossbar, at least two hollow posts disposed in the hollow crossbar, and at least two round holes formed on the hollow crossbar, the press bar having two recess holes, two pairs of slots and at least two cage posts, each of the cage posts having a protruded rod, each of the slots having a slide hole formed in each of the slots, each of the cylinder blocks having a rectangular hole, each of the push blocks having a slide groove to receive a slide block and a helical spring abutting the slide block, each of the push blocks covered by a seal plate on the respective cylinder block, two hollow cushions inserted in the two upper ends of the inner pipes, each of the hollow cushions receiving a compression spring and a connecting rod having a lower end inserted in the respective cylinder block and an upper end disposed outside of the respective hollow cushion, each of the hollow posts receiving a coiled spring and a respective protruded rod, each of the longitudinal outer pipes having a plurality of oblong holes, each of the hollow plates inserted in each of the respective slots, and a pin passing through the respective round hole and the respective slide hole.

2. An extensible handle device as claimed in claim 1, wherein an additional hollow post is disposed in a center of the hollow crossbar, and an additional cage post having a protruded rod is disposed in a center of the press bar.

* * * * *